United States Patent [19]

Hammerschlag et al.

[11] Patent Number: 5,054,646

[45] Date of Patent: Oct. 8, 1991

[54] DISPENSING DEVICE FOR PARKING LOT

[75] Inventors: John W. Hammerschlag, Evanston; Arne Weingart; Andrew R. McLaughlin, both of Chicago, all of Ill.

[73] Assignee: General Parking Corporation, Chicago, Ill.

[21] Appl. No.: 581,961

[22] Filed: Sep. 13, 1990

[51] Int. Cl.[5] ..... B65H 3/58

[52] U.S. Cl. ..... 221/26; 221/154; 221/282; 211/57.1

[58] Field of Search ..... 221/26–28, 221/45, 62, 154, 197, 282, 286, 287; 206/39.1, 39.2, 39.5; 211/54.1, 57.1; 225/106

[56] References Cited

U.S. PATENT DOCUMENTS

| | | | |
|---|---|---|---|
| 271,177 | 1/1883 | White | 221/26 |
| 557,553 | 4/1896 | Chillberg | 221/154 |
| 850,950 | 4/1907 | Muller . | |
| 957,539 | 5/1910 | Berkebile | 221/26 |
| 1,135,658 | 4/1915 | Brown et al. | 221/62 |
| 2,122,637 | 7/1938 | Colburn . | |
| 2,153,278 | 4/1939 | Shelley | 221/26 |
| 2,592,828 | 4/1952 | Segal . | |
| 3,199,723 | 8/1965 | Hein . | |
| 3,291,339 | 12/1966 | Hein . | |
| 3,858,382 | 1/1975 | Suominen . | |
| 4,724,974 | 2/1988 | Marqua et al. . | |

FOREIGN PATENT DOCUMENTS

| | | | |
|---|---|---|---|
| 2035264 | 6/1980 | United Kingdom | 221/26 |

*Primary Examiner*—H. Grant Skaggs
*Attorney, Agent, or Firm*—Irwin C. Alter

[57] ABSTRACT

The dispenser is a box-like structure, preferably made of metal, that is suspended from a wall near an elevator. The structure enables cards stored to be pulled out of the dispenser. A pair of spring-loaded binding screws press the cards forwardly toward the dispenser access opening. In addition to advertising or other material thereon, the cards have the floor location imprinted thereon to help a party parking a car to retrieve same upon returning to the parking lot. The dispenser has a cover that is pivotally mounted to a base plate which is attached to a wall with a fastening means. When loading the cards, the dispenser cover is pivoted upward to allow loading of the cards on the binding screws. Then the cover of the dispenser is pivoted back to its original position, whereupon it is locked with the base plate. This structure enables the dispenser to be held securely against the wall so that it is not easily removed from the wall.

4 Claims, 2 Drawing Sheets

DISPENSING DEVICE FOR PARKING LOT

BACKGROUND OF THE INVENTION

A common problem with parking lots is that after people park their cars, many forget where they parked them. Generally, to prevent this, parking lot owners have provided cards on each floor indicating the floor level where the car is parked. However, in large cities and other places where vandalism exists, it is necessary to provide a dispenser for these cards where removing more than one of the cards from the dispenser is difficult.

Still even further, providing a dispenser which cannot be vandalized or stolen is also necessary.

It is therefore, primarily, an object of this invention to provide a card dispenser for public places where vandalism exists, such as, for instance, a parking lot where the dispenser is attached to and fixedly associated with a wall by fasteners and is difficult to remove.

It is still even further an object of this invention to provide a new and improved card dispenser for a parking lot which has cards that indicate the floor level where the car is parked whereby each floor has one of these dispensers near the elevator and drivers can take a card from the card dispenser to remind them of the floor level where the car is parked.

It is further an object of this invention to provide a card dispenser of the type described having spring biased binding screws that allow the cards to be forwardly urged toward the dispenser opening so that upon removal of a card another card is in position for removal.

It is further an object of this invention to provide a new and improved cover member for the card dispenser that provides for access to the cards while, at the same time, it covers the fastening members that hold the card dispenser to a wall so that vandals are precluded from access to the fastening members and cannot remove the card dispenser easily from the wall by means of removing the fastening members.

It is further an object of this invention to provide a card dispenser with a cover that is pivotally associated with a base plate that is attached to the wall with fastening means and has a lock therein for locking the cover to the base plate of the card dispensing device thereby making it difficult to remove the dispenser from the wall.

In accordance with the last aspect of the invention, it is a further object of the invention to provide the pivotal cover as a means for conveniently and quickly loading and unloading the card dispenser of the type described.

DESCRIPTION OF THE DRAWINGS

Other objects and advantages of the invention will become more readily apparent from the following description taken in connection with the accompanying drawings wherein there is set forth, by way of illustration and example, an embodiment of the invention.

DESCRIPTION OF THE PREFERRED EMBODIMENT

Figure 1:
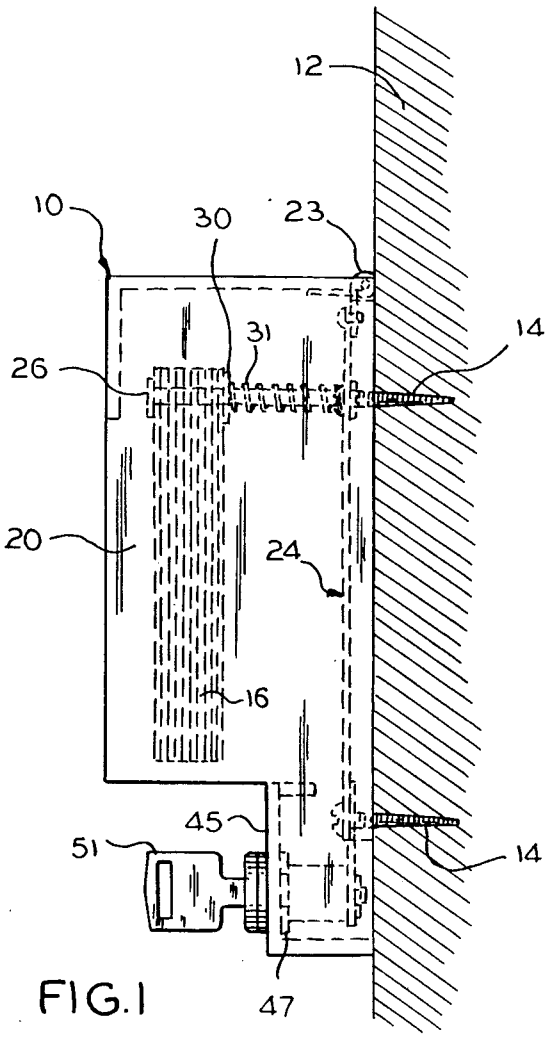
FIG. 1 is a side elevational view of a dispenser showing the dispenser fixedly attached to a wall with fastening means with the cover thereof locked in its operating position.

Referring to the drawings wherein like characters of reference indicate corresponding parts, a dispenser 10, which is essentially, a box-like structure preferably made of metal is shown in FIG. 1, suspended from a wall 12 by means of the threaded fastening members 14. As stated in the objects of the invention, the wall 12 can be near an elevator and the dispensing structure contains and holds the cards 16 by means of a pair of spring-loaded binding screws 18 that press the cards 16 forwardly toward the dispenser access opening 20 to enable a party parking a car to remove the same from the dispenser and thereby more easily retrieve his car due to the floor location imprinted on the card.

Figure 2:
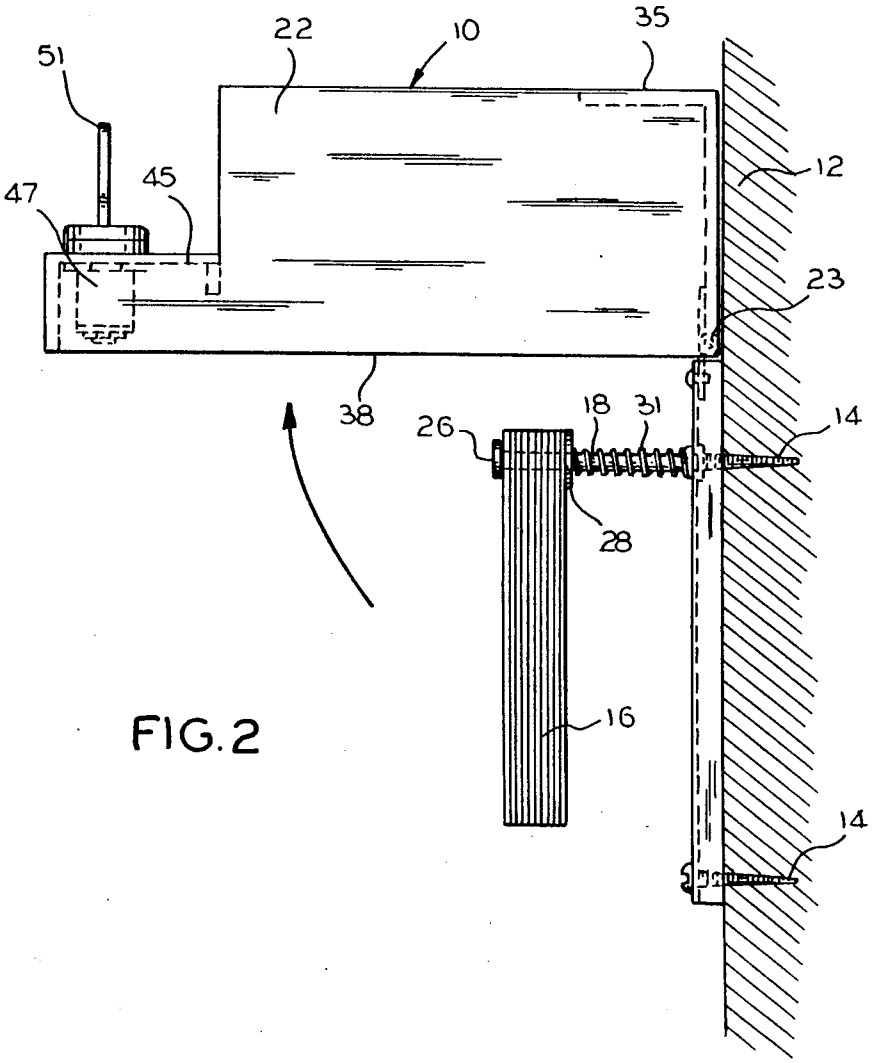
FIG. 2 is a side elevational view, just as FIG. 1, however, with the cover of the dispenser rotated to its open position after the cover lock has been unlocked.
Figure 4:
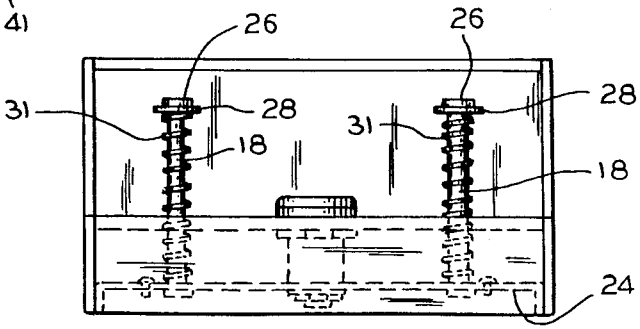
FIG. 4 is a top view of the dispenser with one end of the cover removed.

The dispenser cover 22 is pivotally associated by hinge means 23 with a base member 24 that is formed in the shape of a channel for reasons as will be more readily apparent as this description proceeds. As seen in FIG. 4, the spring-loaded binding screws 18 have heads 26 and washers 28 that are urged by the springs 31 that are shown around the binding screws 18 so that when the cards 16, which have holes (not shown), are on the binding screws 18, as shown in FIGS. 1 and 2, they are held in place by means of the springs 31 urging the washers 28 toward the binding screw heads 26.

Figure 5:
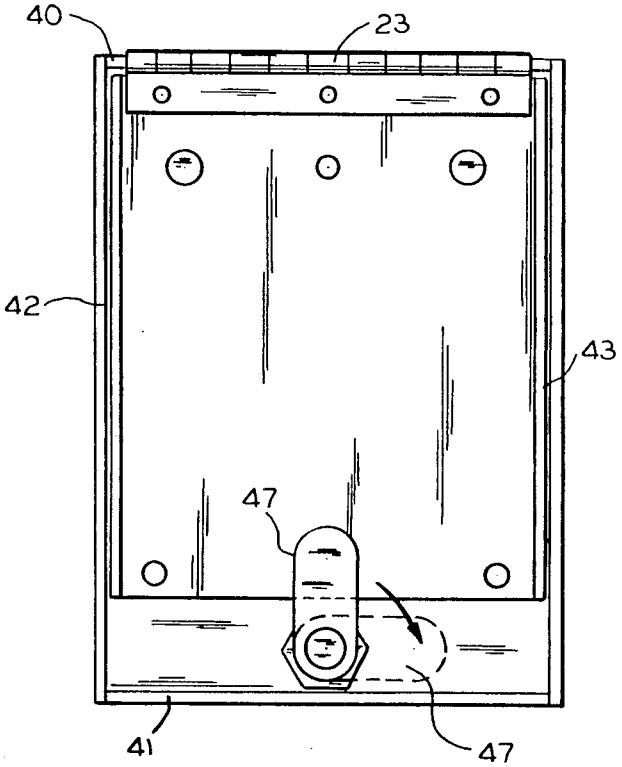
FIG. 5 is a rear view of the back of the dispenser showing how the cover is locked into position with the base plate of the dispenser.
Figure 3:
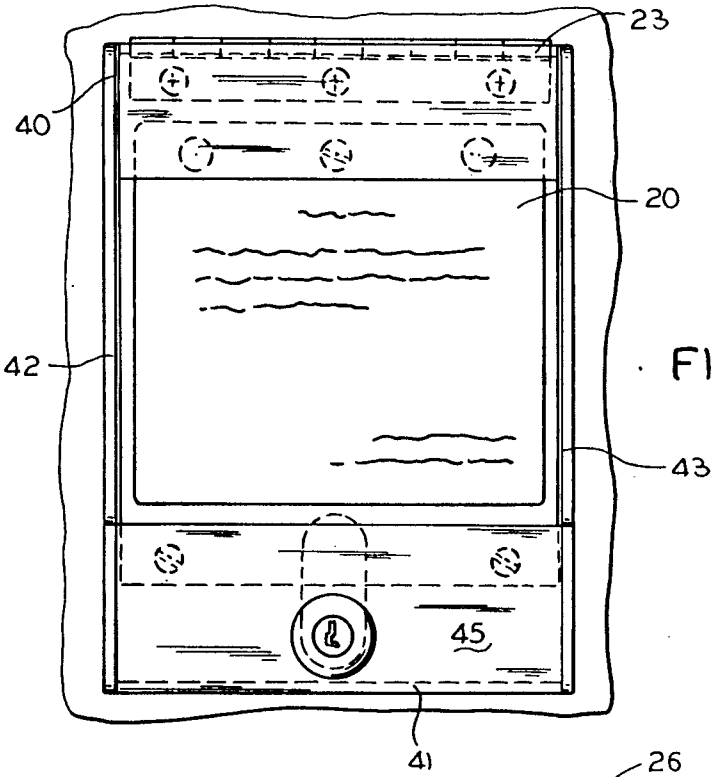
FIG. 3 is a front view of the dispenser illustrating the cover in its locked position whereby access to the cards is provided without exposing the fastening means holding the dispenser to the wall.

To hold the imprinted cards 16 so that they can be grasped and removed from the dispenser, the dispenser cover 22, which is formed of sheet metal, is hollow, with a front that has the dispenser access opening 20 formed therein by a pair of opposing rectangular end walls 42, 43 that have a front face plate 35 disposed and spanning the top of the front of the access opening 20. The cover has a rear opening 38 that is formed by the ends of a plurality of opposing parallel end walls 40, 41 and 42, 43 that are respectively perpendicular to each other. As seen from FIGS. 1 and 3, one of the end walls 41 has a bottom face plate 45 and a locking means 47 extending therethrough and being disposed to cooperate with the channel-shaped base member 24 by having its locking member 49 disposed for pivotable movement from an open position to a closed position where it is positioned behind the channel to preclude rotation of said cover to its open position when said locking means 47 is in its closed position as seen in FIG. 5. When the locking means 47 is in its open position, as seen in phantom in FIG. 5, the locking member is no longer behind the channel member whereby the cover is free to be rotated on its hinging means 23 to the dispenser's open position so that the dispenser can be loaded with cards or have its base plate easily removed, if that is desired. The locking means 47 is preferably shown with a key 51 for enabling rotation thereof.

As seen from the drawings, the spring-loaded binding screws 18 holding the cards on the upper fastening mean 14 are located at the top of the dispenser under the face plate 45 so that easy access to the threaded fastening means or binding screws is precluded by the face plate 45. Thus, removing the cards or the upper fastening means 14 that are holding the base member 24 to the wall as seen in FIGS. 1 and 2, is rendered difficult with this type of design.

It can be seen that the bottom face plate 45 is disposed over the lower fastening means 14 that are holding the base member 24 to the wall to preclude easy access to the bottom fastening means 14 by a vandal.

Thus, in operation, the base member 24 is initially secured to the wall by the upper and lower fastening means 14 where upon the dispenser cover 22 is rotated to its open position to allow for dispenser cards 16 to be loaded onto the spring-loaded binding screws 18. Then dispenser cover 22 is moved to its closed position as shown in FIG. 1, and a key 51 rotates the lock means 47 so that the locking member 49 is in the position illustrated in FIG. 5, thereby precluding rotation of the dispenser cover 22. When it is required to remove one of the cards, a driver merely grasps a card imprinted with the floor so that he can remember where his car is parked.

Although one form of this invention has been illustrated and described, it is not to be limited thereto except as so far as such limitations are included in the following claims.

What is claimed is:

1. A dispenser for holding imprinted cards at a parking lot in order that they can be grasped and removed from the dispenser to indicate where the care is parked, comprising:

a base member that has upper and lower fastening means extending therethrough for association on the base member to a wall, a metal cover with a front thereof that has an access opening therein, said access opening being formed by a pair of opposing parallel rectangular end walls and a front face plate disposed and spanning the top of said dispenser and covering the card holding means and upper fastening means of said base member, said cover being pivotally associated with said base member, and being rotatable from an open position to a closed position, said base member having card holding means extending therefrom to hold the cards to be dispensed from said dispensing means; and locking means selectively locking the dispensing cover to said base means when the cover is in its closed position, said cover being shaped to preclude access to the fastening means holding the base member and having a rear opening that is formed by the ends of a plurality of opposing parallel end walls with one of said end walls having a lower face plate that covers said lower fastening means when said cover is locked in its closed position whereby easy access to the fastening means cannot be obtained unless said cover is unlocked and rotated to its open position.

2. A dispenser as defined in claim 1 wherein said base member is channel shaped and said locking means includes a locking member that can be rotated between a locked position behind said channel forming base member and an open position where it is not behind said base member and said cover is free to rotate about its hinged means.

3. A dispenser as defined in claim 1 wherein said card holding means includes a pair of spring-biased binding screw members that have cards retained thereon and said cards are urged to the front of said dispenser as each card is grasped and removed from said dispenser.

4. A dispenser as defined in claim 1 wherein said binding screws are disposed underneath said upper face plate to preclude easy access and removal of said binding screws.

* * * * *